United States Patent [19]

Kosche

[11] 4,202,566

[45] May 13, 1980

[54] HEAT-SENSITIVE RECORDING OR COPYING MATERIAL

[75] Inventor: Horst Kosche, Düren, Fed. Rep. of Germany

[73] Assignee: Ciba-Geigy Corporation, Ardsley, N.Y.

[21] Appl. No.: 908,888

[22] Filed: May 24, 1978

[30] Foreign Application Priority Data

May 28, 1977 [DE] Fed. Rep. of Germany ..... 2724295
Jul. 1, 1977 [DE] Fed. Rep. of Germany ..... 2729739

[51] Int. Cl.[2] ..... B41M 5/18; B41M 5/22

[52] U.S. Cl. ..... 282/27.5; 106/21; 427/150; 427/151; 428/411; 428/530; 428/537; 428/913; 428/914

[58] Field of Search ..... 106/14.5, 21; 282/27.5; 427/150, 151; 428/307, 411, 913, 914, 530, 537

[56] References Cited

U.S. PATENT DOCUMENTS

| | | | |
|---|---|---|---|
| 3,823,022 | 7/1974 | Thomas | 427/151 |
| 3,859,112 | 1/1975 | Kohmura et al. | 428/913 X |
| 3,896,255 | 7/1975 | Kato et al. | 428/411 |
| 3,900,218 | 8/1975 | Miyamoto et al. | 282/27.5 |
| 4,025,399 | 5/1977 | Matsumoto et al. | 427/150 X |

OTHER PUBLICATIONS

*Hackh's Chemical Dictionary*, 4th ed., 1969, p. 111.

*Primary Examiner*—Bruce H. Hess
*Attorney, Agent, or Firm*—Michael W. Glynn

[57] ABSTRACT

Heat-sensitive recording or copying materials which contain, in their color reactant system, as developers for the color-forming agent, at least one mono- or polyaldehyde which is electronegatively substituted, especially by halogen, and/or the reaction products thereof with an organic compound containing hydroxyl groups, or the precursors thereof.

16 Claims, No Drawings

HEAT-SENSITIVE RECORDING OR COPYING MATERIAL

The present invention relates to colour-producing reactants, which are termed acceptors or developers, for colour-forming agents known per se, which reactants convert the colourless colour-forming agents into intense dyes when the two compounds come together. The invention further relates to heat-sensitive materials for carrying out the colour reaction, for example recording papers or sheets for producing copies.

It is known to produce heat-sensitive copying or recording materials in which a colour-forming agent, which is present in a colourless form and arranged separately, is brought into contact, during the recording operation, with a further reactant which reacts specifically, i.e. a developer, whereupon a deep-coloured record forms.

If both reactants, i.e. the colourless colour-forming agent and the colour-producing acceptor, are incorporated in a common layer, special embeddings and coatings are necessary to safeguard them against premature formation of the dye. These measures are necessary in the case of papers which react by the action of heat. For these, which produce one or more coloured recording traces when subjected to the action of energy, for example heat, it is appropriate separately to coat the two reactants and to initiate the heat-induced reaction between the two by means of a melting solubilising agent, which becomes effective in the form of a liquid, or by means of melting coatings.

Several categories of colour-forming agents which are at most slightly coloured and form intense dyes by reaction with an acceptor are known. Their molecular structure is already largely that of the dyes but they do not possess the dye-forming conjugation and electron distribution. As a result of substituents, cyclisations or adducts, they are prevented from forming the dye configuration and/or from forming the bathochromic dye salt or are in closed ring systems. Some categories of these reactive dyes or their parent compounds have already been described by Friedländer in "Methoden der Teerfarbenfabrikation" ("Methods for the Production of Aniline Dyes"). Thus, currently all colours and shades are available commercially or can be produced and there is likewise no lack of black or light-stable admixtures.

Although there has been no lack of attempts, which have been extensive and carried out world-wide, to find further reactants which produce colour, these components are at present essentially restricted to two categories of substances: aluminium silicates with layer lattices and free active lattice positions, especially montmorillonites or attapulegones (attapulgite) which, as degradation or weathering products of feldspars having a similar lattice structure, are also present in aluminas. In order to increase the activity, these minerals are subjected to gentle hydrolysis by hydrochloric acid or sulphuric acid, as a result of which the alkaline earth metal ions are dissolved out and the layer lattice is widened. Furthermore, deep and brilliant colours are obtained by incorporating chelate-forming heavy metal salts in free positions of the above layer lattice and these colours are also stable to water; and aromatic organic compounds which carry a phenolic hydroxyl on the aromatic system. Although a discernible dye formation is achievable when polyphenols and other phenolic compounds such as tannin or tannic acid are used, the rate of reaction is low with these compounds and the dyes formed are not adequately brilliant or stable for industrial use. Therefore, the choice is currently restricted essentially to compounds of the bisphenol A type or to chlorinated mononuclear or polynuclear phenols, such as p-chlorophenol, 4-(4'-chlorophenyl)-phenol, 4-chlororesorcinol or 2,4-dichlorophenols. Because of their high tendency to migrate in the layers, these compounds are customarily precipitated on substrates such as blank-fix, china clay, fuller's earth or bleaching earths and others and are used in this form. It is immaterial whether the phenolic compounds are used in a solid or liquid form at room temperature, since these compounds display the same activity on their own or when adsorbed on earths or silicon compounds.

Because of the high volatility of the phenolic compounds, their use in coated papers is greatly restricted. Although it has been proposed, in order to reduce the tendency to migrate and to lower the volatility, partially to react the phenols with formaldehyde to give resin-like resols and resites and to use them in this form, especially in combination with substrate pigments, for dye formation, it has not, however, been possible to overcome the defects to which these compounds are subject.

The alumina derivatives which form layer lattices, for example montmorillonite, possess a pigment character. Therefore, clear receiving layers are not obtained on transparent papers or sheets when they are coated with the substances. It is also difficult to incorporate these pigments in printable pastes.

During production and storage, the chlorinated phenols combine particularly readily, because of their high vapour pressure and because of their pronounced tendency to sublimation, with the dye precursors which are arranged separately. They, and also the resins produced therefrom, form dark-coloured products as a result of oxidation. Their stability to light is inadequate.

It is therefore progressive to find colour-producing reactants which in the main do not form any dark-coloured oxidation products and produce brilliant dyes with the known colour-forming agents and which can be so changed by further and controlled reactions that they are adaptable to diverse use forms. Specific embodiments enable thermographic recording material to be produced which records completely without odour.

The present invention relates to a heat-sensitive recording or copying material which contains, in its colour reactant system, as the developer for the colour-forming agent, at least one electronegatively substituted mono- or poly-aldehyde and/or a reaction product thereof with an organic compound containing hydroxyl groups, or the precursors thereof.

The reaction products are preferred to the free aldehydes. In the mono- or poly-aldehyde, preferably at least one electronegative substituent interacts electromerically with at least one aldehyde group.

The mono- or poly-aldehydes, which are employed as such or as reaction products with a hydroxy compound, are preferably of the formula

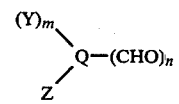

(1)

in which Q is a radical of one of the formulae R, M, M—$(R)_n$, R—M—$(R)_n$, M—R—M or M—R—M—$(R)_n$, in which R is a substituted or unsubstituted, saturated or unsaturated aliphatic radical and M is a substituted or unsubstituted, aromatic, aromatic-cycloaliphatic, aromatic-heterocyclic or heterocyclic radical with aromatic properties, Y is a strongly electronegative substituent, Z is hydrogen or an acid group and m and n are each an integer from 1 to 6.

Aldehydes of particular interest are those of the formulae given below

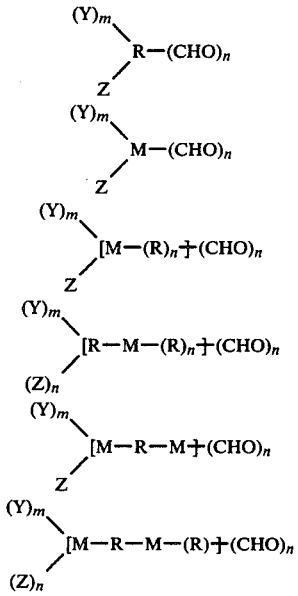

(2)

(3)

(4)

(5)

(6)

(7)

in which M, R, Y, Z and n are as defined.

The radical M can be a mononuclear or polynuclear ring system, the aldehyde group or groups being attached directly to the ring system, which has aromatic properties, or interacting with at least one conjugated ring system via a Y on a R or by a conjugation. Preferably, M is an aromatic radical, for example phenylene.

Preferably, R is an aliphatic saturated or unsaturated radical which can carry further substituents which do not influence the activity of Y on the aldehyde group, or do so to only a minor extent. If R is located between a conjugated aromatic, heterocyclic or aromatic-heterocyclic ring system with aromatic properties and the aldehyde group, R must either carry Y or have a linking conjugation between the aldehyde group and M. If R is between several M, it is advantageous when R contains a conjugation to M or, if the polarising action of the aldehyde group suffices, contains Y. The grouping C=O or C=S can be present in place of the conjugation. Saturated R contains at least one substituent Y in the α-position relative to the aldehyde group and unsaturated R which is in the α-position and conjugated to the aldehyde group contains at least one substituent Y on the unsaturated groupings or adjacent to these. To obtain greater polarisation of the aldehyde group, it is advantageous if several Y are present in the α-position and/or, if desired, β-position relative to this group. If Y is on the aromatic or heterocyclic system having aromatic properties, Y is to be so located that its maximum negative activity on the aldehyde group is obtained.

At least one Y is a strongly negative substituent, such as halogen or the cyano group, which is in resonance or interaction with the aldehyde group.

The acid grouping Z is in particular a carboxylic acid group or sulphonic acid group or also hydrogen.

Furthermore, the polymeric aldehydes, which are formed by polymerisation and/or polycondensation from the aldehydes of the formulae (1) to (7), can also be used if at least one aldehyde group is retained in the free form, or the monomers can be reformed, at least partially, from these polymers by the action of heat, electrolysis, catalysts or a change in the hydrogen ion concentration.

For specific applications it can be advantageous to use the aldehydes in the form of their salts, including those which have as the base a polymeric substance, for example polyimines, basic salts of polymeric carboxylic acids, cyclic organic bases, or basic ion exchangers or basic pigments.

Strongly negatively substituted aldehydes in which the negative substituents interact with the aldehyde group form adducts with water, alcohols and acids, including with the polymeric compounds thereof. The hydrates as a rule are defined compounds. The hydrates, which are usually crystalline, give up the water only at elevated temperature, the aldehydes being formed again. They are particularly useful according to the invention. For the production of the materials containing the developer, it is furthermore particularly valuable that the hydrates are not oxidised by atmospheric oxygen. They are also stable to boiling water and to dilute acids. Above their melting point, or on distillation, they are split, the aldehydes being liberated.

For special uses, the compounds of chloral with sulphuric acid are valuable, since they both have an acid reaction and act as a developer. They can be used particularly advantageously for the reaction with those reactive colour-forming agents which require developers which act in an acid medium in order to produce colour. Mucochloric acid and also monochloromalonic acid aldehyde and dichloromalonic acid aldehyde have a similar activity. The formation of hydrates goes in parallel with an increased activity as developers. The electronegative substituent on the aldehyde and the radical Y in the formulae (1) to (7) are preferably halogen, such as bromine or, in particular, chlorine.

Particularly suitable aldehydes are of the formula

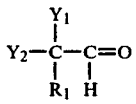

(8)

in which $Y_1$ is hydrogen or halogen, $Y_2$ is halogen and $R_1$ is halogen, carboxyl, alkyl having 1 to 3 carbon atoms, halogenoalkyl having 1 to 3 carbon atoms, phenyl, benzyl or halogenobenzyl.

The following aldehydes are suitable, for example, as developers or as a co-reactant with the hydroxy compound:

Table I

| Aldehyde |
|---|
| Bromoacetaldehyde |
| Trichloroacetaldehyde |
| Tribromopropionaldehyde |
| α-Chlorocrotonaldehyde |
| 2,2,3-Trichlorobutyraldehyde |
| α,α,β-Trichlorohydrocinnamaldehyde |

Table I-continued

| Aldehyde | |
|---|---|
| α-Chloro-α,β-dibromohydrocinnamaldehyde | or the corresponding hydrate |
| Polymeric chloral | |
| Metachloral | |
| 2,3-Dichlor-3-phenylpropionaldehyde | |
| 2,2,3-Trichloro-3-phenylpropionaldehyde | |
| 2-Chloro-2,3-dibromo-3-phenylpropionaldehyde | |
| 2,2,3-Trichloro-3-(3'-chlorophenyl)-propionaldehyde | |
| 2,3-Dichlorocinnamaldehyde | |
| 1,2-Dichloro-3-thiophenyl-propionaldehyde | |
| 1-Carboxy-1,2-dichloroethan-2-al | |
| 1,1,3,3-Tetrachloropropane-1,3-dial | |
| α,α-Tetrachloroxylidene dialdehyde | |
| Tetrachloroglutaconic acid dialdehyde | |
| 2,4,6-Trichlorobenzaldehyde | |
| 1,3,5-Trichlorobenzophenone-4-aldehyde | |
| 2,3,5-Trichlorobenzophenone-4-aldehyde-4-carboxylic acid | |
| 1,1-Dichloro-1-(4'-chlorophenyl)-1-(phenyl-4''-aldehyde)-methane | |
| 2,3,4-Trichloro-pentanedien-1-al | |
| 5-Carboxy-2,2,3-trichlorobutan-1-al | |

Amongst the many suitable aldehydes, polymeric trichloroacetaldehyde containing at least one free aldehyde group, 2,2,3-dichloropentanal, 2,3-dibromo-3-dichloropropional or, preferably, trichloroacetaldehyde (=chloral) have proved particularly advantageous.

As already mentioned, the aldehydes are preferably employed in the form of their reaction products with an organic hydroxy compound or the precursors thereof. In these reaction products, the aldehyde is bonded to the radical of the reactant via at least one oxygen atom, half-acetals or full acetals, α-halogenoacetals, α-halogenoacylals, ethers or acylals being formed.

Reactants of this type are, thus, the actual compounds containing hydroxyl groups, but also carboxylic acid chlorides, α-hydroxycarboxylic acids, epoxides, dicarboxylic acid anhydrides, enols, hydroxyketones, hydroxyaldehydes, half-acetals, ether-alcohols and ester-alcohols and halogenoalcohols, which can contain further substituents. Compounds of primary interest are organic hydroxy compounds, epoxides, carboxylic acid halides and/or dicarboxylic acid anhydrides.

Amongst these compounds, those which are preferred are, in turn, substituted or unsubstituted aliphatic alcohols, ether-alcohols, ester-alcohols, halogenoalcohols, half-acetals, hydroxycarboxylic acids, hydroxyaldehydes, hydroxyketones, enols, carboxylic acid anhydrides or carbohydrates.

Preferred compounds are, in particular, organic hydroxy compounds, such as monomeric or polymeric sugars, their ethers, esters or halogenation products, sugar alcohols, uronic acids, aminosugars, sulphhydryl-sugars, alginic acid, alginic acid esters, pectins, cellulose, cellulose esters, cellulose ethers or glycolic acid, pentosans or pentosanglycolic acids, starch, starch esters or starch ethers or aminostarch.

Amongst these hydroxy compounds, those which have proved suitable are, in particular, the hexoses and the sugar alcohols having 3 to 6 carbon atoms. Specific compounds are: ethylene glycol, glycerol, d-sorbitol, erythritol, pentaerythritol, xylitol, glucose, cellulose, starch or 1,3-dichloro-2-chloromethyl-propan-2-ol.

By varying the aliphatic, cycloaliphatic, aliphatic-aromatic or heterocyclic radicals in the reactants, it is possible to produce a large number of developers which differ in their physical and chemical properties and can be adapted to the desired use forms. By means of controlled reactions it is possible, therefore, to obtain liquid or solid compounds with different melt characteristics and also pasty, amorphous or crystalline developers, but also waxy or plastic developers, as well as those compounds which are plasticisers for plastics. Since the aldehydes and the reactive compounds used for the reaction can contain further substituents and it is necessary to impose a restriction on the substituents only to the extent that these hinder the reaction, the possibilities for variation are manifold.

The organic hydroxy compounds used for reaction with the aldehydes according to the invention are not restricted to monohydroxy compounds and the aldehydes are not restricted to monomeric aldehydes. It has, in fact, been found that polyhydroxy compounds, especially those which result in a 5-membered or 6-membered acetal ring when forming the acetal with the aldehydes, are particularly useful developers because of their stability. Because of the given ring structure of the acetals, polyhydroxy compounds containing hydroxyl groups adjacent to one another are particularly valuable for producing the acetals which are effective as developers. These hydroxy compounds are derived, for example, from ethylene glycol, glycerol, pentaerythritol and further known polyalcohols having functional groups in the α,β-position, but also from polyhydroxy acids. However, α-hydroxycarboxylic acids, for example lactic acid as a model substance, also form acetal-like compounds with the negatively substituted aldehydes in such a way that the oxygen atom of the aldehyde group continues to remain in the ring system as a result of reaction with the hydroxyl group in the α-position, and the hydroxyl on the carboxyl group is also drawn into the reaction.

Compounds of primary interest as developers are reaction products of the formula

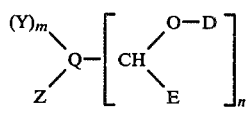

(9)

in which Q, Y, Z, m and n are as defined, D is hydrogen or a substituted or unsubstituted aliphatic radical and E is a substituted or unsubstituted aliphatic radical bonded via oxygen to —CH<, or is halogen, and D and E, if they are a substituted or unsubstituted aliphatic radical, are bonded via an ether or ester bridge to —CH<, and D and E can also be bonded direct to one another.

Amongst these developers preferred compounds are, in turn, those of one of the formulae

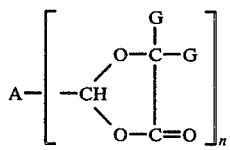

(10)

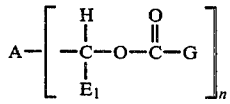

(11)

-continued (12)

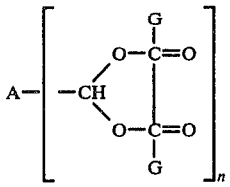

(13)

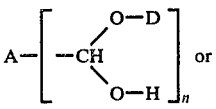

or (14)

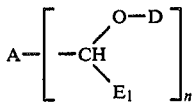

in which A is one of the radicals indicated in the definition for Q, attached to the aldehyde group, G is an aliphatic, aromatic or heterocyclic radical or hydrogen, $E_1$ is halogen, n is an integer from 1 to 6 and D is as defined. The radical A is a radical required to complete the negatively substituted aldehydes of the formulae (1) to (8), to which one or several aldehyde groups, corresponding to n=1-6, are attached, D is a radical of a hydroxy compound, E is halogen, such as bromine or preferably chlorine, and G is preferably the radical of a polyhydroxy compound, of a hydroxy acid, of an α-hydroxysulphonic acid or of a dicarboxylic acid anhydride and also further members for completing an organic chain molecule or ring system, which can carry further substituents.

Developers which have proved particularly valuable are those which are obtained by reacting chloral with glycerol, erythritol, sorbitol, glucose or 1,3-dichloro-2-chloromethylpropan-2-ol and, if desired, by a subsequent acetylation of the reaction product.

As will be explained in detail below, the materials according to the invention preferably contain spiranes, triphenylmethane compounds, flavones, chromans, fluoranes, polymethine compounds or phthalides as the colour-forming agents.

In a particular embodiment of the present invention, the developers are used in combination with structure-forming substances, such as silicates, silicic acids, cellulose, pigments or aluminas. Furthermore, a combination of the developers with chelate-forming metal salts of the transition elements with acids has proved advantageous. Preferably, the thermoreactive material also contains a binder.

The present invention also relates to a heat-sensitive composition which contains at least one developer of the indicated composition, a colour-forming agent and, if desired, a binder and also to a process for the production of recordings with the aid of a heat-sensitive recording material containing a colour-forming agent, a developer of the indicated composition and, if desired, a binder.

If the developers to be used according to the invention are in the form of liquids or of compounds which melt below 40° C., it is advantageous, for certain use forms, to incorporate them in known microcapsule systems or cellular layers, or to combine them with structure-forming substances. Structure-forming substances of this type are celluloses, starch, silicic acid, silicates, inert pigments, bleaching earths, paper fillers and porous plastics. It can also be advantageous to use them together with other known developers, for example aluminas.

Since no restriction is imposed on the hydroxy compounds in respect of their molecule size and their further substitution, very diverse monomeric compounds or their polymeric derivatives can be used to form the developers. If, for example, substituted polyalkanes containing hydroxyl groups in the side chain, for example the hydroxy-esters of the polymeric poly-alkylcarboxylic acids or the dehydrogenation products of aldehydes or carboxylic acids, or fatty alcohols, for example hydroxystearyl alcohol, polyglycols containing free hydroxyl groups, polyvinyl alcohols, waxes or paraffins containing hydroxyl groups, or fatty alcohols obtained from the oxo synthesis are reacted with compounds of the general formulae (1) to (8), fusible and/or plastic masses are obtained. Because of their fusibility and plasticity, these are outstanding developers for heat-sensitive materials, since they can be adapted, by means of their melt properties, to desired room temperatures, which may be employed to produce several recorded traces of different colours with different response temperatures.

On the other hand, polymeric hydroxy compounds can advantageously be used to form developers stable to migration, by reaction with the aldehydes according to the invention. Such compounds are, for example, the partial linear polyesters obtained from pentaerythritol and adipic acid and having 2 free hydroxyl groups in the molecule, the glycerides of di-hydroxystearic acid, polyvinyl alcohols, copolymers of maleic anhydride and vinyl ether, and polyesters of di-hydroxysuccinic acid and ethylene glycol or hexanediol.

Developers showing a particular advance are obtained by reacting the negatively substituted aldehydes with carbohydrates. Compared with conventional compounds, they possess a large number of the properties promoting industrial use and can be adapted to manifold desired use forms, so that it is possible to use a novel category of developers, provided by the invention, as starting materials.

The reactions to be carried out have to a large extent been described in the literature. In the case of the carbohydrates, the conversion reaction always proceeds in accordance with the same reaction mechanism, although even simple sugars and their macromolecular polymers consisting of identical or mixed monomers occur in many sterically different forms. For example, simple sugars are differentiated by different glycoside ring systems and also according to whether the glycoside bond is in the α- or β-position. Dimeric or polymeric sugars also possess the same ring systems and occur, for example, as furanoses or pyranoses. The bonding of the sugars to one another is of the trehalose, cellobiose, turanose, maltose, gentobiose, lactose, raffinose, cellulose or starch type, or other types, and some sugars also possess an open molecule chain. However, the reaction products of the aminosugars and of the pentosans, the uronic acids, the polyuronic acids, the sugar acids and the sugar alcohols, for example sorbitol, can also be used according to the invention. Sugars and uronic acids of different molecule sizes, which are designated in accordance with the number of oxygen atoms and which are derived from glyceraldehyde as the simplest sugar or from glyceraldehyde-carboxylic acid as the simplest uronic acid, can also be used after reaction with the aldehydes. Furthermore, the sugars are classified as aldoses, ketoses or as sugars which do not reduce Fehlings solution, sugar alcohols or their polymers, which as a rule are susceptible to the reaction with the aldehydes.

Since the reaction between carbohydrates and the negatively substituted aldehydes of formulae (1) to (8) takes place between the carbohydrate hydroxyl and the aldehyde group, the oxygen atom of the aldehyde group remaining in the reaction product of formulae (9) to (14), and the steric relationships are also substantially similar, it is certainly permissible to apply the reaction between simple sugars and trichloroacetaldehyde, carried out in the case of the model substance and resulting in developers, to the entire category of carbohydrates and their partial reaction products if the monomeric structural unit of polymeric carbohydrates contains in the molecule at least one free and sterically accessible hydroxyl, for the formation of a half-acetal, or 2 sterically accessible hydroxyl groups, at which a 4-membered to 7-membered, preferably 5-membered to 6-membered, full acetal ring is able to form. In the case of mono- and di-saccharides, uronic acids, sugar-like polyalcohols, for example sorbitol, aminosugars, for example glucosamine, and also other carbohydrate compounds which have adequate hydroxyl, the reaction with the aldehyde can also take place several times. In the case of polymeric sugars, which form longer chain molecules or crystallides, it is also possible for the point of reaction to be between two hydroxyl groups, each of which belongs to a different molecule chain. It is also possible, before or after the reaction in order to obtain the developer properties, to carry out other additional substitution reactions, for example a reaction with acid anhydrides, acetone, acetyl chloride, halogen, zinc chloride, epoxides, for example ethylene oxide, or with alkyl halides or aryl halides, for example methyl chloride, ethyl chloride or benzyl chloride, with chloroacetic acid, phosgene and bases, with lower fatty acids, for example with acetic acid, propionic acid or butyric acid, with propanesultone or with other aldehydes which do not impart developer properties, if a negatively substituted aldehyde was or is available for reaction with the hydroxyl groups required to form the developer. Furthermore, the primary hydroxyl group of the sugars is readily susceptible to oxidation to the uronic acids.

The model substances formed from simple saccharides and trichloroacetaldehyde possess outstanding developer properties and are exceedingly valuable for industrial use since they can be produced easily and also inexpensively:

Table II

| | |
|---|---|
| α-Trichloroethylidene-d-gluco-furanose (α-glucochloralose) | Melting point 182° C. |
| β-Trichloroethylidene-d-gluco-furanose (β-glucochloralose) | Melting point 228° C. |
| α-(Di-trichloroethylidene)-d-glucose (dichloralose I) | Melting point 268° C. |
| Glucodichloralose II | Melting point 228° C. |
| Glucodichloralose III | Melting point 135° C. |
| β-3,5,6-Trimethyl-trichloroethylene-d-glucose (trimethylglucochloralose) | Melting point 109° C. (120° C.) |
| β-3,5,6-Triacetyl-trichloroethylidene-d-glucose (triacetyl-β-glucochloralose) | Melting point 108° C. |
| 3-Methyl-(di-trichloroethylidene-d-glucose) (3-methyl-dichloralglucose) | Melting point 111° C. |
| Monoacetyl-(di-trichloroethylidene)-d-glucose (acetyl-di-glucochloralose) | Melting point 95.5° C. |
| Pentaacetyl-α-trichloroethylidene-d-glucose | Melting point 174° C. |
| Pentaacetyl-β-trichloroethylidene-d-glucose | Melting point 151° C. |
| Trichloroethylidene-d-glucuronic acid (chloralonic acid) | Melting point >300° C. |
| Trichloroethylidene-thioglucose | |
| β-Trichloroethylidene-d-xylose (xylochloralose) | Melting point 132° C. |
| β-d-Xylochloral acid | Melting point >300° C. |
| β-Dimethyl-trichloroethylidene-d-xylose | Melting point 53° C. |
| β-Diacetyl-trichloroethylidene-d-xylose | Melting point 142° C. |
| α-Tetraacetyl-trichloroethylidene-d-xylose (syrup) | |
| β-(Di-trichloroethylidene)-d-xylose | Melting point 202° C. |
| β-Dibenzene-(trichloroethylidene)-d-xylose | |
| β-Trichloroethylidene-arabinose (α-arabochloralose) | Melting point 183° C. |
| α-Trichloroethylidene-1-arabinose (α-arabochloralose) | Melting point 124° C. |
| α-Trichloroethylidene-1-araburonic acid (α-arabochloral acid) | Melting point 307° C. |
| α-Tribromoethylidene-1-arabinose | Melting point 210° C. |
| Trichloroethylidene-d-levulose | Melting point 228° C. |
| α-2-Chloroethylidene-d-glucose | Melting point 168° C. |
| α-2,2-Dichloroethylidene-d-glucose | Melting point 165° C. |

The reactions of the model substances indicated above can be applied to and employed with virtually all carbohydrates, including cellulose, starch, polyuronic acids and pentosans, but also celluloseglycolic acid and also cellulose ethers and esters and starch ethers and esters reacted retaining free hydroxyl groups.

Thus, ether-like compounds between chloral and degraded cellulose, which were obtained by reaction in pyridine or quinoline and are soluble in pyridine, have been described in German Offenlegungsschrift 408,821, without, however, the effectiveness of these compounds as developers having been discerned.

The working methods for the production and for the further reaction of developers from carbohydrates and aldehydes can be taken from the literature with appropriate use of the aldehydes suitable according to the invention.

The formulae of some typical developers are listed below:

β-trichloroethylidene-d-gluco-furanose

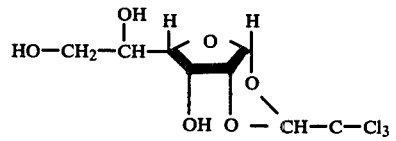

(15)

β-(di-trichloroethylidene)-d-gluco-furanose

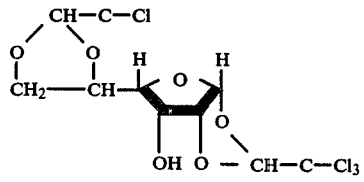

(16)

β-d-trichloroethylidene-d-gluconic acid (furanose type) formed from formula (15) by oxidation with nitric acid (d=1.2) or $N_2O_5$:

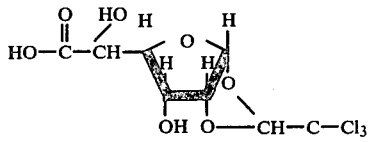

(17)

chain sections of an acceptor obtained from trichloroacetaldehyde and cellulose:

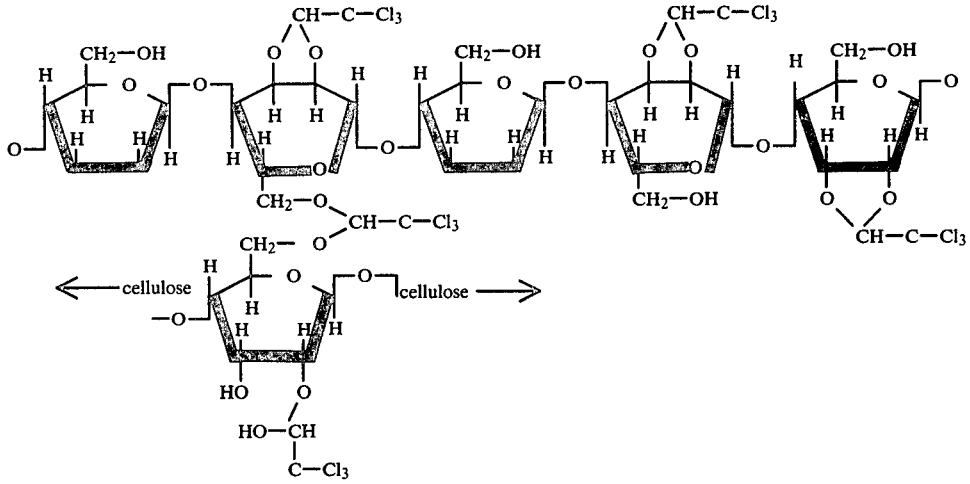

The reaction products of the sugars with the negatively substituted aldehydes are capable of undergoing further reactions with acid chlorides, such as acetyl chloride, and metal salts, for example zinc chloride, or oxidation with nitric acid or $N_2O_5$. Thus, with zinc chloride and acetyl chloride, α-chloralose forms a compound which melts at 145° C. and β-chloralose forms a compound which melts at 106° C., which compounds are also effective as developers.

The α- and β-glycoside mixed products of the reaction of sugars and aldehydes can also be used for industrial application as developers. They are particularly valuable when the lowering in temperature due to mixed melting characteristics results in a lowering of the response temperature of the heat-sensitive material. Frequently, these mixed products are also fully adequate for industrial use, so that separation can be dispensed with. However, it can also be advantageous to carry out purification in order to utilise the differences in the melting points and in the solution properties of the two compounds.

The developers used according to the invention as a rule possess the following outstanding properties, which make them particularly suitable for coatings or embeddings on or in carrier materials:

Stable to oxidation by atmospheric oxygen,

Stable to dilute acids at temperatures >100° C.,

Compounds which are stable at least up to the melting point temperature and which in some cases can even be distilled in vacuo without decomposition, Virtually colourless Wide melting range and thus adaptable to different recording temperatures; gradeable and variable for multi-coloured recordings by choice of the response temperature, Virtually odourless at room temperature and during thermographic recording, Production of developers which are slightly soluble or insoluble in water and are therefore suitable for use for aqueous coating compositions which can be produced easily, Production of developers soluble in conventional solvents; suitable for incorporation in sheets, lacquer layers, adhesive layers or non-fusible layers, Stable to migration because of the molecule size and therefore particularly inert towards premature reaction, Substances structurally related to starch and cellulose; therefore can be combined with paper pulp and are suitable for the production of developer layers in a papermaking machine, Production of self-supporting sheets or layers of the following compounds reacted with negatively substituted aldehydes:

celluloseglycolic acids, polyuronic acids, alkyl- or benzoylcelluloses or starches, cellulose esters, alkylation products of cellulose or starch, or their soluble salts if the latter contain acid groupings, Spontaneous formation of dyes, which are outstandingly stable and virtually do not fade, with colour-forming agents, under the action of heat or of quantities of energy which can be converted into heat, for example laser light or infrared rays, or by initiation of chemical reactions supplying heat, and Production of moisture-resistant colorations which, in contrast to those obtained from clays and colour-forming agents, do not lose their colour on moistening with water.

The developers which are obtained from carbohydrates and negatively substituted aldehydes and are to be used according to the invention can be adapted to manifold use forms. For example, compounds of different solubilities and different melt characteristics are accessible from glucose and trichloroacetaldehyde by varying the reaction conditions and by separation methods.

The reaction of glucose with chloral hydrate results in a mixture of α- and β-monochloralose and dichloraloses, which already is outstandingly useful as a developer. This mixture softens at about 85° C. α-d-

Chloralose, which has a melting point of 182° C., and β-d-chloralose, which has a melting point of 228° C., can be isolated from this mixture by means of simple separation methods. Dichloralglucoses are obtained by reacting 1 mol of glucose with in excess of 2 mols of chloral hydrate and sulphuric acid. They have a melting point of above 135° C. A dichloralglucose with a melting point of 268° C. is obtained as the main product by recrystallisation. If, for example, β-3,5,6-trimethylglucose is reacted with chloral and sulphuric acid, β-3,5,6-trimethylglucochloralose with a melting point of 120° C. forms. A triacetyl-β-glucochloralose with a melting point of 108° C. is obtained by reacting β-chloralose with acetic anhydride and pyridine.

Of these compounds, α-chloralose is slightly soluble in water but readily soluble in alcohol and ether. The dichloraloses are completely insoluble in water, whilst the acetylation and methylation products are particularly readily soluble in organic solvents, even in hydrocarbons. All the compounds mentioned above are effective developers.

Experimental findings now show that, for example, when forming dyes by the action of heat, one of the reactants should be in the liquid form or in the form of a solution. Particularly intense dyes with high stability to water are, now, obtained if at least one of the reactants melts during the recording but the dye complex which thus forms is again in the form of a solid after the heat has dissipated. The fact that a melt phase forms as an intermediate to initiate the colour reaction in the case of reactants which predominantly are insoluble in water is exceedingly valuable for industrial use since the aqueous coating compositions can be produced, and dried, without special safety precautions. Thus, completely surprisingly, it is possible, for example, to grind α-glucochloralose, which has a melting point of 182° C., with reactive colour-forming agents, such as crystal violet lactone or 2-phenylamino-3-methyl-6-diethylamino-fluorane, together in an aqueous polyvinyl alcohol solution, at 20°–30° C. in a ball mill, to form a staining colour, without discernible colour formation taking place. This staining colour is storable for a virtually unlimited period, so that it can also be supplied to the consumer for coating purposes.

If, for example, this coating composition is coated onto paper and dried in a stream of air at 100° C., there is again no discernible colour formation. If, on the other hand, the dried reactive layer is brought into contact with an adequate source of heat, for example a hot needle of a cardiograph, a detailed recorded trace which is rich in contrast and water-resistant forms. The use of this procedure alone already results in an outstanding technical advance compared with the conventional procedure, in which, for example, bisphenol A and crystal violet lactone are ground in separate batches with polyvinyl alcohol, to produce a coating, and these separate ground products are mixed only shortly before the coating is applied, whereupon the coating composition immediately develops a slightly blue coloration.

By means of the developers having graded melt characteristics, it is possible to develop multi-coloured thermographic recording materials in which a colour such as yellow, red, blue, green or black is assigned to a characteristic recording temperature and is developed on controlled heating. For this purpose, developers are used in a mixture with colour-forming agents, the developer being suited to the temperature at which the colour forms. Because of their different solubilities in water and in organic solvents, it is possible to form layers which, without partially dissolving the subsequent layer, can be deposited on top of one another or alongside one another. These layers now contain colour-forming agents which develop different colours. By means of a differentiated supply of heat, it is now possible to produce multicolour recordings and colour mixtures can also be obtained.

On the other hand, it is possible to form layers or inserts which contain the differently coloured colour-forming agents together. For this purpose, coated particles are produced from the latter together with the developers, which have been suited to the energy potential with regard to initiation of the reaction, and an admixture thereof is used. In addition, if desired, the coating binders, which consist, for example, of gelatin/carbohydrate complexes or of different polyvinyl alcohols, are suited to the melt characteristics. In order to vary the melt characteristics, partial reactions with aldehydes or aminoplast-forming precondensates or reactions with masked polyisocyanates which become reactive only after the water has been driven out, or with polyvalent metal ions can be used. The polyvinyl alcohols can be varied by preparation from copolymers containing non-saponifiable monomers or by partial or complete saponification. The latter, which have only a slight solubility in water, are curable by chromium complexes.

For special uses, especially for incorporation in structure-forming substances or substrates, it can be advantageous to introduce the aldehydes of the formulae (1) to (8), and the hydroxy compounds, in the monomeric form, after which they are converted into their partial homo- or co-polymers by known measures and reacted with compounds containing hydroxyl groups. These are as a rule solid substances which have a lower vapour pressure than the monomers and possess a considerably slighter tendency to migrate. Moreover, these can be coated by simpler measures, which are less complex than the production of microcapsules. If the structure-forming substrate substance is polymeric silicic acid, a particularly brilliant dye forms after reaction with the reactive compounds. The depth of shade and brilliance are further increased, and water-resistant dyes are formed, if the structure-forming substances contain salts with metals which form chelates. The chelate-forming heavy metals, such as zinc and copper, but also barium, calcium and aluminium and also silver are particularly valuable.

The structure-forming substances are not restricted solely to inorganic lattices or amorphous substances. On the contrary, organic polymers, such as cellulose, can also be used. Furthermore, it is possible to prepare the acetals by reacting the negatively substituted aldehydes with epoxides. The full acetals or cyclic ethers are obtained particularly simply and in high yield by this means if the reaction is carried out under pressure. On the other hand, full acetals are also accessible in the case of polymeric compounds by means of α-halogenoethers, which can be obtained in the form of acylals from carboxylic acid chlorides and aldehydes, or also by subsequent chlorination of ethers, which can be polymeric. The full acetals are obtained from the above α-halogenoacetals by reaction with alcohols or the metal alcoholates with the elimination of the halogen. However, transacetalisation is also a method which can be employed to prepare the developers according to the invention.

A further method for the preparation of preferably highly polymeric developers comprises reacting polymerisable unsaturated carboxylic acid halides, for example acrylyl chloride, methacrylyl chloride or 2,3-dichloroacrylyl chloride, with negatively substituted aldehydes to give α-halogenoacylals or α-halogenoethers. The halogen atom is then replaced by the ether radical of a compound containing hydroxyl groups, in the presence of an alkali metal. The full acylal formed is then subjected to polymerisation.

The following sequence of formulae is given as an example. Chloral adds on acrylyl chloride to give

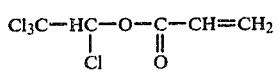

(19)

This compound is converted, for example using Na methylate in the cold, to the acylal-ether of the formula

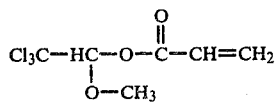

(20)

and then the latter is polymerised by the method known from the polymerisation of acrylic acid.

Polymeric plastics of this type are suitable as developers for forming a dye.

In general, the addition of metal salts has proved advantageous in order to accelerate the formation of the dye and to reduce the response sensitivity to heat. These salts are preferably used together with the developers. The metals of the transition elements already mentioned in connection with the aluminas and also the heavy metals are particularly suitable, but barium, magnesium or aluminium can also be used in the form of their organic or inorganic salts.

In the course of the experimental work it has, now, been found that the formation of the dye takes place, especially when reproducing fine details, when forming the dye by the action of heat, essentially only as a surface reaction between the developer particles and the colour-forming dye precursors. Therefore, in order to limit the amount of developer introduced into the reactive layers, it has proved advantageous to deposit these developers in thin surface layers on carrier substances. These particles or grains coated with developer material fulfil virtually the same purpose as the same amounts of pure developer material. If the formation of the dye is not completely adequate, the particles coated with developer can be combined with a developer, which if desired can have different colour-forming characteristics. The coating is effected e.g. by precipitating the dissolved developer in a suspension of the carrier material, in the liquid phase of which the developer and the carrier are insoluble. Furthermore, dissolved developers and solid substrate particles can be subjected together to spray-drying, by which means pulverulent substances are obtained. Developers containing acid groups can also be precipitated easily on basic pigments. Developers containing free aldehyde groups act on albumin or gelatin particles and thus form a surface-layer which acts as a developer.

The developers of this specification are outstandingly suitable for forming dyes or colorations with the known colour-forming agents. The colour-forming agents originate from the categories of the spiranes and of the triphenylmethane, polymethine, phthalide, chroman, fluorane and also polyimine dyes. Examples of particularly suitable colour-forming agents are 2-phenyl-3-methyl-6-diethylaminofluorane, crystal violet lactone, benzoyl-leucomethylene blue, 6-diethylamino-3-methyl-2-chlorofluorane, 6-diethylamino-2-dibenzylamino-4-methylfluorane and rhodamine-B-lactam.

Of course, the different forms of use require specific types of embedding, coating and separation or the formation of separate layers on or in the carriers. Measures of this type are known to those skilled in the art. The choice of suitable solubilising agents, which, for example, when heat is applied cause the reaction to proceed more rapidly or more completely, are also known or can be determined by simple experimentation in series tests.

As already mentioned, the developers to be used according to the invention can be suited to manifold use forms. These are heat-reactive recording materials, for example for medical purposes, for cardiographs and encephalographs, for registering thermo-recorders or printers for computers, calculators, ticket printers and printable heat-sensitive layers of printing pastes or printing inks which are supplied as prefabricated material to the processor. Adaption to the desired use forms in some cases makes it necessary to employ a different layer build-up.

METHODS OF PREPARATION

A.

178.0 g (1 mol) of 1,3-dichloro-2-chloromethyl-propan-2-ol are dissolved in 300.0 ml of toluene and the solution is added to a solution of 2.5 g of p-toluenesulphonic acid and 222.0 g (1.5 mols) of anhydrous chloral.

The solution is left to stand at room temperature for 4 hours and the water, which boils as an azeotrope with the toluene, is then separated off by boiling under reflux, with the aid of a water separator. 11.7 g (0.65 mol) of the water to be separated off pass over in the first hour and the rate at which the water is separated off then slows down noticeably. After boiling for 14 hours, a total of 14.04 g (0.78 mol) of water are separated off. The reaction is now discontinued.

The toluene and the remaining amounts of chloral and 1,3-dichloro-2-chloromethyl-propan-2-ol are now distilled off under a pump vacuum. The residue is taken up in chloroform, the solution is filtered through charcoal and the chloroform is then driven off in vacuo.

234 g of a crystal mass in the form of needles remain. When purified by sublimation, the compound melts at 65° C. The resulting compound is identified as the half-acetal of chloral with trichloromethylcarbinol of the formula given below

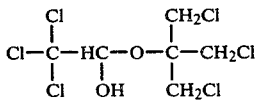

(21)

If this compound is brought into contact with a 5% strength solution of crystal violet lactone in chloroparaffin 60, which contains 60% by weight of chlorine, a deep blue coloration forms.

B.

2-Trichloromethyl-1,3-dioxalone-4-carbinol is prepared in a yield of 48% from anhydrous glycerol and chloral, using the method of Ross & Payne, Journal Am. Chem. Soc. 45, 2363 et seq. (1923).

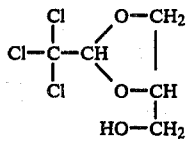

(22)

The highly viscous liquid is purified by distillation in vacuo.

The trichloromethyl-1,3-dioxalone-4-carbinol is coated onto cellulose paper and brought into contact with a 5% strength by weight solution of 3,3-bis-(1'-ethyl-2'-methylindol-3'-yl)-4,5,6,7-tetrachlorophthalide dissolved in chloroparaffin 60 and mineral oil of boiling point >230° C. An intense red coloration forms.

C.

Preparation of: isomeric gluco-di-chloraloses, β-gluco-chloralose and α-chloralose.

In a double-walled steel vessel of 2,000 ml capacity, which can be cooled by means of salt water and which is provided with a twin stirrer operating in opposing directions, 300 g of chloral hydrate and 750 g of sulphuric acid monohydrate (1.84) are mixed together at 8°–10° C. in such a way that no separation of the layers takes place.

200 g of anhydrous glucose are added to this mixture and the viscous mass is stirred for 4 hours at 10° C. It is then cooled to 6° C. and left to stand for 24 hours for ripening. During this time the mass develops only a slight reddish coloration. 2 kg of ground ice and 2 kg of water are introduced into a vessel possessing a rotating knife head and the mass prepared above is introduced in portions, with comminution. The bulk of the solution is decanted off from the white precipitate which settles on the base and the precipitate is again suspended in 0.5 kg of water and then filtered off. The mother liquor I is retained.

The filter residue is suspended in 0.5 kg of water and solid sodium hydroxide is added in small portions until the pH is 8–9. The wash water is filtered off, the residue is twice suspended in 0.5 kg of water and filtered off and the filter cake is washed with water until free from chloral and sodium sulphate. The residue consists of isomeric dichloraloses. 116 g of these are obtained and these can be used as developers without further purification. The melting point is 224° C. after recrystallisation from ethanol.

Isolation of β-glucochloralose

The mother liquor I, containing sulphuric acid, is transferred to a 5 l round-bottomed flask and boiled up. The solution becomes turbid at 80° C. and β-glucochloralose starts to separate out. The solution is allowed to cool slowly, and β-glucochloralose crystallises out. Yield 50 g. The crystal fraction which is obtained from ethanol and has a melting point of 228° C. consists of β-glucochloralose.

Isolation of α-glucochloralose

After isolating the β-glucochloralose, the mother liquor is carefully neutralised to pH 5.5 with sodium hydroxide solution and evaporated in a vacuum evaporator to ¼ to 1/5 of the original volume. α-Glucochloralose, which is contaminated with $Na_2SO_4$, separates out. The precipitate is filtered off and washed on the filter with small portions of water. The filter cake can already be used as a developer. Yield 75 g, dry weight.

For purification, the filter cake is dissolved in hot ethanol and the solution is filtered hot. Water is now added in an amount such that the ethanol content is about 40%. The solution is cooled to 0° C. α-Glucochloralose with a melting point of 182° C. crystallises out on prolonged standing.

Aqueous suspensions of the isomeric dichloraloses, of β-glucochloralose and of α-glucochloralose are so coated onto separate paper sheets that a dry weight of about 2 g/m² results. If a 5% strength by weight solution of crystal violet lactone in chloroparaffin 60, which contains 60% by weight of chlorine, is applied as spots to this coating, an intense blue colour forms in the areas of contact.

D.

Pine sulphite pulp, which has been beaten in a refiner into average fine paper fibre lengths, is dried in vacuo at 60° C. until the water content is 2%.

Hydrogen chloride is passed into 165.3 g (1 mol) of the dried and beaten pulp, in a round-bottomed flask fitted with a reflux condenser, with frequent shaking until 3 g has been taken up. 295.0 g of anhydrous chloral are now added and the entire pasty mass is stirred round several times and left to stand at 10° C. for 6 hours, the vessel being closed.

2.0 g of p-toluenesulphonic acid are then added and the mixture is refluxed for 2–3 hours, during which time a slight yellowish-red discoloration arises. The mixture is cooled and left to stand for 14 hours at 12° C.

The pasty pulp-like mass is freed from excess chloral on a glass filter, twice stirred up cold in 2 l of 50% strength by weight aqueous methanol and filtered off immediately. The mass is then introduced into 3 l of water and mechanically defibrated and the pH is adjusted to 5.5–6 with 50% strength sodium hydroxide solution.

The reaction product is then washed twice on the filter with, in each case, 500 ml of warm water at 40° C. and dried in a vacuum desiccator. It contains about 6% of water. Yield 269 g.

The chlorine content determined analytically is 32.5%, corresponding to a degree of conversion of about 0.8.

If the pulp-like developer is brought into contact with a 5% strength by weight solution of crystal violet lactone in chloroparaffin containing 60% of chlorine and a mineral oil, a blue coloration forms.

E.

Using the experimental arrangement as in Example 3, 182 g (1 mol) of d-sorbitol are introduced into a mixture, which has been cooled to 8° C., of 368 g (2.5 mols) of chloral and 970 g of sulphuric acid of d=1.84, with stirring.

The mixture, which remains colourless, is stirred vigorously for 6 hours at 8°–10° C. and is then left to stand for 24 hours at the same temperature. A pasty mass forms which is difficult to stir.

After the reaction has ended, this mass is introduced slowly, with vigorous stirring in order to avoid the formation of lumps, into 5 l of ice-water. The tacky product which flocculates out and easily agglomerates is separated off from the strongly acid precipitant water.

3 l of water at 20° C. are poured over the crude reaction product and the product is defibrated and neutralised to pH 5 with sodium hydroxide. The wash water is immediately separated off and the operation is repeated until the pH remains constant at 5.

Water is now poured over the reaction product and the mixture is left to stand for 10 hours. During this time the mass converts to crystal aggregates, which can now be comminuted easily. The water is filtered off and the product is washed several times, on the suction filter, with water.

After drying in air and subsequently in a desiccator, 192 g=64% of trichloroethylene-sorbitol (sorbochloralose) are obtained in the form of hygroscopic crystal aggregates, which on standing in air become plastic and melt at 70° C. with softening.

When the product is reprecipitated from aqueous methanol, a chlorine content of 36.5% is found. d-Sorbochloralose is slightly soluble in water and very readily soluble in lower alcohols. If d-sorbochloralose is brought into contact with crystal violet lactone, an intense brilliant blue dye forms spontaneously.

F.

In order to prepare di-trichloromethylene-erythritol, 124 g of erythritol are dissolved in 450 g of 65% strength by weight sulphuric acid at room temperature and 360 g of chloral hydrate are added.

The solution is stirred intensively. After a short time, the mixture solidifies to a crystalline mass, which is left to stand for 3 hours at 35° C.

The crystals are filtered off with suction on a glass frit suction filter and washed with 300 ml of water. The mother liquor is poured into 5 l of water, whereupon a second fraction precipitates. The bulk of the mother liquor is decanted off and discarded and the precipitate is filtered off and combined with the first fraction. The product is now washed carefully acid-free and the dichloral-erythritol is recrystallised from aqueous ethanol. Yield 78%.

If crystalline dichloral-erythritol is brought into contact with a solution of crystal violet lactone, a deep blue intense coloration forms. This is also obtained by melting together dichloral-erythritol and crystal violet lactone.

EXAMPLE 1

Batch A

By dissolving 9.0 kg of a polyvinyl alcohol of medium viscosity which has a degree of saponification of 86–90% and a residue of 10–14% of vinyl acetate in the molecule, in 151.0 kg of water, with stirring and warming to 85° C., a 5.62% strength by weight solution is prepared. 8.5 kg of a solid polyethylene glycol ether which melts at 45° C. and has been melted with stirring are dispersed in this solution, which is kept at 80° C., and the dispersion is cooled to 20° C., with stirring. An opaque, slightly pasty dispersion forms.

Batch B

A vibratory mill is charged with 20.0 kg of water, 2.5 kg of a basic ion exchange resin containing a quaternary ammonium group and 10.0 kg of 2-phenylamino-3-methyl-6-diethylaminofluorane and the mixture is ground to a particle size of 8 to 20 microns. After the grinding process has ended, batch A is added to this mixture and the resulting mixture is tested to determine whether it gives an alkaline reaction. If necessary, the pH is adjusted to 9–10 by adding 5% strength by weight ammonia.

The mass is now ground in the vibratory mill for 2 hours at 20°–30° C. A vinyl acetate content of about 6–10% in the polyvinyl alcohol is advantageous for forming a lyophilic coating.

The ground product is designated reactive I.

Batch C 25.0 kg of a finely disperse silicic acid which dries matt are filled into a ball mill, which can be cooled, 5.0 kg of water are added and the mixture is ground for about 30 minutes until the water is uniformly distributed. 25.1 kg (0.17 mol) of trichloroacetaldehyde are now added and the whole is mixed for a further 1 hour, with cooling, until the formation of the hydrate is complete. 150.0 kg of a 5% strength by weight aqueous solution of the polyvinyl alcohol defined under A are then added and the whole is ground for a further 2 hours. The mixture is then rendered alkaline, to pH 9–10, with 5% strength ammonia.

This preparation is designated reactive II.

In order to produce a thermographic recording paper, reactives I and II are mixed with a stirrer. The mixture is again tested to determine whether it has an alkaline reaction and if necessary the pH is adjusted with ammonia.

The coating composition is coated onto a cellulose paper having a weight per unit area of 50 g/m$^2$ in a metered amount, and dried at 50°–70° C., depending on the residence time, in a warm stream of air, so that the dry amount applied is 1.0–3.0 g/m$^2$.

If the product prepared in this way is brought into contact with the hot needle of a cardiograph, a black-coloured recording trace forms in the heated regions.

Polymeric trichloroacetaldehyde which contains at least one free aldehyde group, 2,2,3-dichloropentanal or 2,3-dibromo-3-dichloropropional can also be employed, in place of trichloroacetaldehyde, with similar success.

EXAMPLE 2

20 g of a partially hydrolysed low-molecular polyvinyl alcohol with a degree of polymerisation of 500, a degree of hydrolysis of 86–90% and a saponification number of 140 are dispersed in 380 g of water and dissolved at 90° C., with stirring, to give a clear solution and the solution is cooled. The solution is transferred to a vibratory mill and 72 g of α-glucochloralose, having a melting point of 182° C., 6 g of crystal violet lactone and 2 g of 3,3-bis-(1'-ethyl-2'-methylindol-3'-yl)-phthalide are added.

The mixture is ground, using balls, to an average particle size of 10μ in the course of 2 hours.

A cellulose paper provided with a satin finish on one side and having a weight per unit area of 50 g/m$^2$ is coated, under a doctor, with the above ground coating composition and dried at 80°–90° C. in a stream of warm air, in such a way that a coating weight (dry) of 4–5 g/m$^2$ results. It is advantageous to smooth the surface coat.

The heat-sensitive recording paper produced in this way has a pure white surface and shows no trace of discoloration resulting from the production of the coating composition or from the coating with this composition and the drying thereof. It is completely odourless. After storage for three months, no discoloration was discernible.

The other developers prepared according to the methods of preparation, or the aldehydes or their hydrates or reaction products according to Tables I and II can also be employed, in place of α-glucochloralose, with equal success.

The heat-sensitive recording paper produced in this way is used in a cardiograph for recording. A violet diagram which is rich in contrast and has good depth of shade and displays all details is obtained. In contrast to conventional heat-sensitive recording papers, no odour is discernible during recording. The paper also does not burn through when the equipment is stopped, for example when making customary contact corrections.

The recording layer can be inscribed with ink, drawing ink, ball point pen and pencil in a flawless manner and without any line running. It can be printed with aqueous ruling inks and also with printing inks for letterpress printing, offset printing, flexographic printing and gravure printing.

EXAMPLE 3

In place of the colour-forming agent used in Example 2, 2 g of 2-dibenzylamino-6-diethylaminofluorane, 4 g of 3,3-bis-(1'-ethyl-2'-methylindol-3'-yl)-4,5,6,7-tetrachlorophthalide, 2 g of crystal violet lactone and 1.5 g of zinc chloride are used to produce the coating composition. Otherwise the constituents employed are the same as those in Example 2. The coating composition is applied to the following carrier materials:

A tracing paper weighing 60 g/m$^2$,

A typing paper weighing 45 g/m$^2$ which can be used for photocopying,

A rag-content paper weighing 40 g/m$^2$ which has been rendered transparent with hydrocarbon resins, Heat-stable sheets of poly-p-phenylenediamine and terephthalic acid, of poly-terephthalic acid glycol esters, of polycarbonates or of regenerated cellulose. These contain adhesive layers or interlayers; and A tracing paper which has been pre-lacquered with heat-resistant plastics, for example hydroxyethylcellulose, in order to repel the aqueous coating compositions.

The coating composition is applied to the abovementioned carriers in a metered amount, and dried at 60°–65° C. in a stream of warm air, so that a reactive layer weighing about 8 g/m$^2$ forms.

The addition of metal salts results in a considerable increase in the sensitivity to heat and increases the depth of shade, but demands gentle drying.

The reactive layer is colourless and has about the opacity of tracing paper. It can be inscribed by the conventional writing agents, such as ink, ball point pen or drawing ink.

If this material is warmed, for example by focused red laser light or heat rays, by means of a hot needle or by means of codable heat sources from semi-conductors, a black recording analogous to the signal forms.

The material inscribed in this way is suitable for the production of copies either by the transparent copying process or by the episcopic process.

If, for example, a cardiogram is produced on transparent paper provided with a heat-sensitive coating and light-sensitive diazo paper is placed beneath this and the whole exposed to actinic light, a positive copy rich in contrast forms after developing. The material is also outstandingly suitable for reproduction by xerographic processes.

EXAMPLE 4

80 g of isomeric gluco-di-chloralose and 14 g of 2-phenylamino-3-methyl-6-diethylamino-fluorane are added to 250 g of a 5% strength by weight aqueous solution of polyvinyl alcohol, prepared as in Example 2, and the mixture is ground for 3 hours in a vibratory mill. The writing composition thus obtained is applied to a cellulose paper weighing 60 g/m$^2$ and dried at 80° C. in a stream of warm air and smoothed.

If, for example, the coated paper is brought into contact with a hot needle or with heated letters, an intense black recording forms, in accordance with the application of heat.

EXAMPLE 5

25 g of α-gluco-chloralose are dissolved in 200 g of ethanol at 60° C. and the solution is kept at this temperature.

100 g of rice starch are dispersed in 1 l of water and 5 g of aqueous 40% strength formaldehyde are added.

With dispersing, the ethanolic solution of α-glucochloralose is now allowed to run in slowly in such a way that the α-glucochloralose is deposited mainly on the surface of the starch grains. The addition of a small amount of a 1% strength by weight sodium hydroxide solution during dispersion ensures that the neutral point is maintained. The starch prepared in this way is centrifuged off from the water and dried.

The dispersion can be used further direct in order to prepare coating compositions.

If a coating composition is prepared in accordance with Example 2, 1½ times the amount of the starch adduct can be used in place of α-glucochloralose in order to obtain an approximately identical depth of shade.

EXAMPLE 6

6 g of an aqueous dispersion which contains 1.57% of crystal violet lactone and 6.7% of polyvinyl alcohol are mixed with 134 g of an aqueous dispersion which contains 14% of 4,4-isopropylidenediphenol, 8% of developer and 6% of polyvinyl alcohol. This mixture is applied to a paper and dried. A blue colour is obtained when the paper is brought into contact with a heated ball point pen.

The reaction products obtained using methods of preparation A to F or those of Table II or the aldehydes according to Table I are employed as developers, with comparable success.

What is claimed is:

1. In a heat sensitive recording or copying material which contains, in its color reactant system; a color-producing acceptor as the developer for the color-forming agent, the improvement wherein the developer contains at least one member which is the reaction product of an electronegatively substituted aldehyde and an aliphatic organic compound containing hydroxyl groups, such that the aldehyde moiety is bonded to the radical of said aliphatic organic compound via at least one oxygen atom, said electronegatively substituted aldehyde being an electronegatively substituted mono- or polyaldehyde, wherein at least one such electronegative substituent is halo or cyano and interacts electromerically with at least one aldehyde group thereof, said aldehyde having the formula

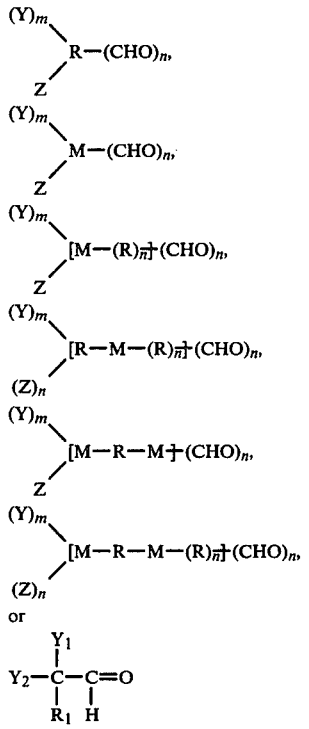

wherein

R is a substituted or unsubstituted, saturated or unsaturated aliphatic radical, M is a substituted or unsubstituted aromatic, aromatic-cycloaliphatic, aromatic-heterocyclic or heterocyclic radical with aromatic properties, Y is halo or cyano, Z is hydrogen or an acid group, m and n are independently an integer of 1 to 6, $Y_1$ is hydrogen or halogen, $Y_2$ is halogen, and $R_1$ is hydrogen, carboxyl, alkyl of 1 to 3 carbon atoms, halogenoalkyl of 1 to 3 carbon atoms, phenyl, benzyl or halogenobenzyl.

2. A material according to claim 1, in which the aldehydes are of one of the formulae

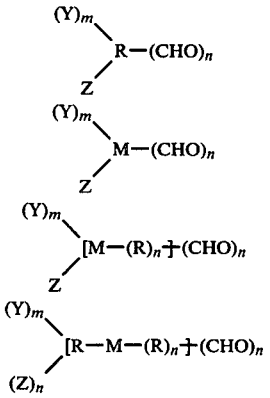

-continued

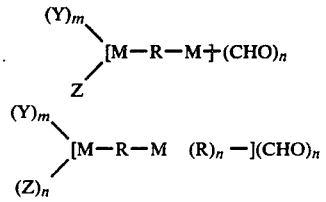

3. A material according to claim 1, in which the electronegative substituent on the aldehyde is halogen.

4. A material according to claim 1, in which the aldehyde is of the formula

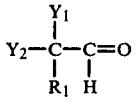

in which $Y_1$ is hydrogen or halogen, $Y_2$ is halogen and $R_1$ is halogen, carboxyl, alkyl having 1 to 3 carbon atoms, halogenoalkyl having 1 to 3 carbon atonms, phenyl, benzyl or halogenobenzyl.

5. A material according to claim 4, in which the aldehyde is polymeric trichloroacetaldehyde with at least one free aldehyde group, 2,2,3-dichloropentanal, 2,3-dibromo-3-dichloropropional or trichloroacetaldehyde.

6. A material according to claim 1, in which the organic hydroxy compounds are substituted or unsubstituted aliphatic alcohols, ether-alcohols, ester-alcohols, halogenoalcohols, half-acetals, hydroxycarboxylic acids, hydroxyaldehydes, hydroxyketones, enols, carboxylic acid anhydrides or carbohydrates.

7. A material according to claim 1, in which the organic hydroxy compounds are monomeric or polymeric sugars, their ethers, esters or halogenation products, sugar alcohols, uronic acids, aminosugars, sulfhydryl sugars, alginic acid, alginic acid esters, pectins, cellulose, cellulose esters, cellulose ethers or glycolic acid, pentosans or pentosanglycolic acids, starch, starch esters or starch ethers or aminostarch.

8. A material according to claim 1, in which the organic hydroxy compound is a hexose or a sugar alcohol having 3 to 6 carbon atoms.

9. A material according to claim 1, which contains developers which are obtained by reacting chloral with glycerol, erythritol, sorbitol, glucose or 1,3-dichloro-2-chloromethylpropan-2-ol.

10. A material according to claim 1, which contains the developers in combination of silicates, silicic acids, cellulose, pigments or aluminas as structure-forming substances.

11. A material according to claim 1, which contains spiranes, fluoranes, triphenylmethane compounds, flavones, chromans, polymethine compounds and polyimine compounds or phthalides as colour-forming agents.

12. A material according to claim 1, which contains the developers in combination with chelate-forming metal salts of the transition elements with acids.

13. A material according to claim 1, which contains a binder.

14. A process for producing recordings with the aid of a heat-sensitive recording material containing a colour-forming agent, a developer and, if desired, a binder in which the developer has the composition indicated in claim 1.

15. A material according to claim 1, wherein the developer is a reaction product having one of the formula

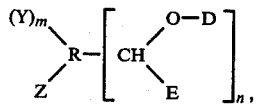

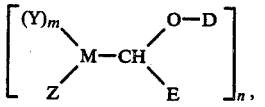

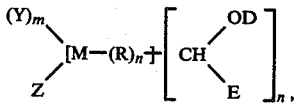

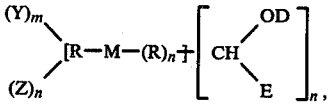

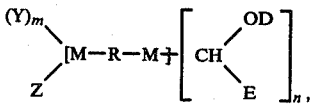

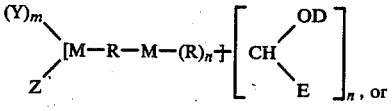 , or

-continued

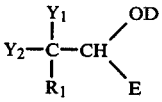

in which Y, Z, M, R, M, m and n are as defined in claim 1, D is hydrogen or a substituted or unsubstituted alipahtic radical, and E is a substituted or unsubstituted aliphatic radical bonded via oxygen to

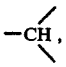

or is halogen, or D and E are a substituted or unsubstituted aliphatic radical bonded via an ether or ester bridge to

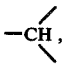

and wherein D and E can be bonded direct to one another.

16. A material according to claim 1, which contains a developer obtained by reacting chloral with glycerol, erythritol, sorbitol, glucose or 1,3-dichloro-2-chloromethyl-propan-2-ol followed by subsequent acetylation of the reaction product.

* * * * *